United States Patent [19]

Dulin

[11] Patent Number: 4,500,938

[45] Date of Patent: Feb. 19, 1985

[54] FASTENER DRIVING DEVICE

[75] Inventor: Kerry Dulin, Highland Park, Ill.

[73] Assignee: Textron, Inc., Providence, R.I.

[21] Appl. No.: 467,162

[22] Filed: Feb. 16, 1983

[51] Int. Cl.[3] ..... H01H 47/32

[52] U.S. Cl. ..... 361/153; 227/131; 361/152

[58] Field of Search ..... 361/152, 153, 155, 156; 307/252 UA; 227/131

[56] References Cited

U.S. PATENT DOCUMENTS

| | | | |
|---|---|---|---|
| B367,812 | 1/1975 | Avery | 227/131 |
| 3,179,866 | 4/1965 | Doyle | 318/125 |
| 3,215,864 | 11/1965 | Doyle | 307/88.5 |
| 3,247,439 | 4/1966 | Doyle | 320/1 |
| 3,267,337 | 8/1966 | Doyle | 317/148.5 |
| 3,434,026 | 3/1969 | Doyle | 318/125 |
| 3,786,978 | 1/1974 | Manganaro | 227/8 |
| 3,824,678 | 12/1975 | Avery | 227/131 |
| 4,183,453 | 1/1980 | Barrett | 227/131 |
| 4,417,681 | 11/1983 | Bernecki et al. | 227/131 X |

*Primary Examiner*—Reinhard J. Eisenzopf

*Attorney, Agent, or Firm*—Cushman, Darby & Cushman

[57] ABSTRACT

A fastener driving device such as a tacker, including an actuating circuit for producing a power stroke for substantially a complete half cycle of an AC potential supply and which occurs a fixed number of cycles following the actuation of a switch actuable at random times with respect to the cycles of the AC supply. The circuit features a decade counter clocked by the AC supply. One of the decade count outputs of the counter provides a signal for firing an SCR in series circuit with a solenoid for powering the tool. The counter is wired in circuit so as to latch at a predetermined count higher than the count output from which the firing signal is taken. Actuating the switch causes the counter to reset to zero, after which it counts positive half-cycles of the AC. When it reaches the count corresponding to the output from which the firing signal is taken, the tool is actuated. The counter continues to count until it relatches. It remains at the latched count until the switch is again actuated. Protection is provided against unintended tool actuation when power is first applied.

32 Claims, 3 Drawing Figures

FASTENER DRIVING DEVICE

BACKGROUND OF THE INVENTION

This invention relates in general to fastener driving devices and more. More specifically, to control circuits for electrically operated fastener driving devices such as for example electric tackers.

An example of an electrically operated tacker is shown in the commonly assigned U.S. patent application Ser. No. 294,422, of Bernecki et al, filed Aug. 19, 1981, now U.S. Pat. No. 4,417,681. That application is hereby incorporated by reference into the present specification. For tackers, such as the Bernecki et al tacker it is appropriate to energize the tacker's solenoid for no more than a single cycle of commercially available A.C. power. Various analogtype circuits are known and used for this purpose, such as, for example, U.S. Pat. No. 3,215,864—Doyle et al (Nov. 2, 1965), the teachings thereof being incorporated herein by reference. In the Doyle et al circuit, a unidirectional controlled conduction device, such as a silicon controlled rectifier (SCR) is used to close a power circuit so that current will flow in an electrical load such as the tacker's solenoid winding. Current flow through the solenoid winding causes a mechanical power stroke to be produced for effecting a tacking operation.

Known control circuits generate a gate signal for triggering the SCR on the first properly poled half cycle of an applied A.C. voltage after the randomly timed actuation of a switch by a user. The control circuit also includes means for preventing the application of a further gate signal to the SCR until the switch is released and then reactuated by the user.

These known actuating circuits use some sort of analog scheme for generating the gate signal for triggering the SCR to "fire" the solenoid. For example, in the Doyle U.S. Pat. No. 3,215,864, a charge is built up on a capacitor. When the switch is actuated this charge is used to generate the gate signal. This is a rather typical approach to generating the firing signal.

SUMMARY OF THE INVENTION

The present invention provides a fastener driving device featuring a digital control circuit for generating the firing signal. It includes a decade counter for counting a predetermined number of cycles of the applied AC power following the actuation of a firing switch. It then provides a counter output signal when the desired number of cycles have been counted. The counter output signal is coupled to a firing circuit which develops a firing signal for turning on an SCR in series circuit with a solenoid for providing a power stroke for the tacker.

A clock pulse generator circuit, coupled to the power input terminals of the circuit, generates clock pulses corresponding to the positive half cycles of the input AC potential. These clock pulses are coupled to the clock input of the counter so that the counter effectively counts cycles of the applied power. The counter is wired so as to latch at a count higher than the desired number of AC cycles to be counted before firing. This latching is accomplished by coupling the intended latch count output of the counter to its clock enable input to disable the counting of clock pulses.

A switch, actuable at a random time with respect to the AC cycles, is wired in circuit so as to provide, upon its actuation, a reset signal to the counter. When the counter is reset, it begins to count up from zero and provides a counter output signal to the firing circuit when the desired number of cycles have been counted. This is accomplished by taking the output from the counter pin corresponding to the desired count of the counter.

There is, in essence, provided by the present invention a fastener driving device comprising: a housing assembly defining a drive track; a driver movably engaged within the drive track; a magazine for feeding fasteners to the drive track for being driven by said driver; a solenoid for moving said driver through a drive stroke in the drive track; a circuit, including a controlled conduction device such as an SCR having a control electrode, for conducting power from an AC potential source to the solenoid to energize it whenever a firing signal is applied to the control electrode; a switch having a normally "off" position and a "fire" position operable at random times relative to the cycles of said AC potential; and a counter circuit for (a) counting the cycles of AC potential occurring after an actuation of the switch means from its normally "off" position to its "on" position and (b) applying a firing signal to the control electrode to place the control electrode in a conductive state during a properly poled half cycle of the AC potential occurring a predetermined number of cycles greater than one (1) after the actuation of the switch, the conductive state of the SCR causing the solenoid to be energized, and (c) preventing the application of a further signal to the control electrode after the application of the firing signal until the switch is returned to its "off" position and reactuated to its "fire" position.

There is also provided by the present invention a fastener driving device comprising: a housing assembly defining a drive track; a driver movably engaged within the drive track; a magazine for feeding fasteners to the drive track for being driven by said driver; a solenoid for moving the driver through a drive stroke in the drive track; a circuit, including a controlled conduction device such as for example an SCR having a control electrode, for conducting power from an AC potential source to the solenoid to energize it whenever a firing signal is applied to the control electrode; a switch, having a normally "off" position and a "fire" position, operable at a random time relative to the cycles of said AC potential source; a counter for counting a predetermined number of cycles of AC potential occurring after an actuation of the switch to said "fire" position and providing a counter signal indicative thereof; and a firing circuit, coupled to the counter for (a) providing a firing signal responsive to the counter signal, to the control electrode for causing the controlled conduction device to conduct during the first properly poled half cycle of AC potential occurring after the counter signal thereby energizing said solenoid and (b) preventing the application of a further signal to the control electrode after the application of the firing signal until the switch is returned to its "off" position and reactuated to its "fire" position.

BRIEF DESCRIPTION OF THE DRAWINGS

An exemplary embodiment of the present invention will be described in detail with reference to the drawings. The described embodiment is the presently contemplated best mode for carrying out the invention although it is to be considered a nonlimitative example. In the drawings.

DETAILED DESCRIPTION OF THE PREFERRED EMBODIMENT

Figure 1:
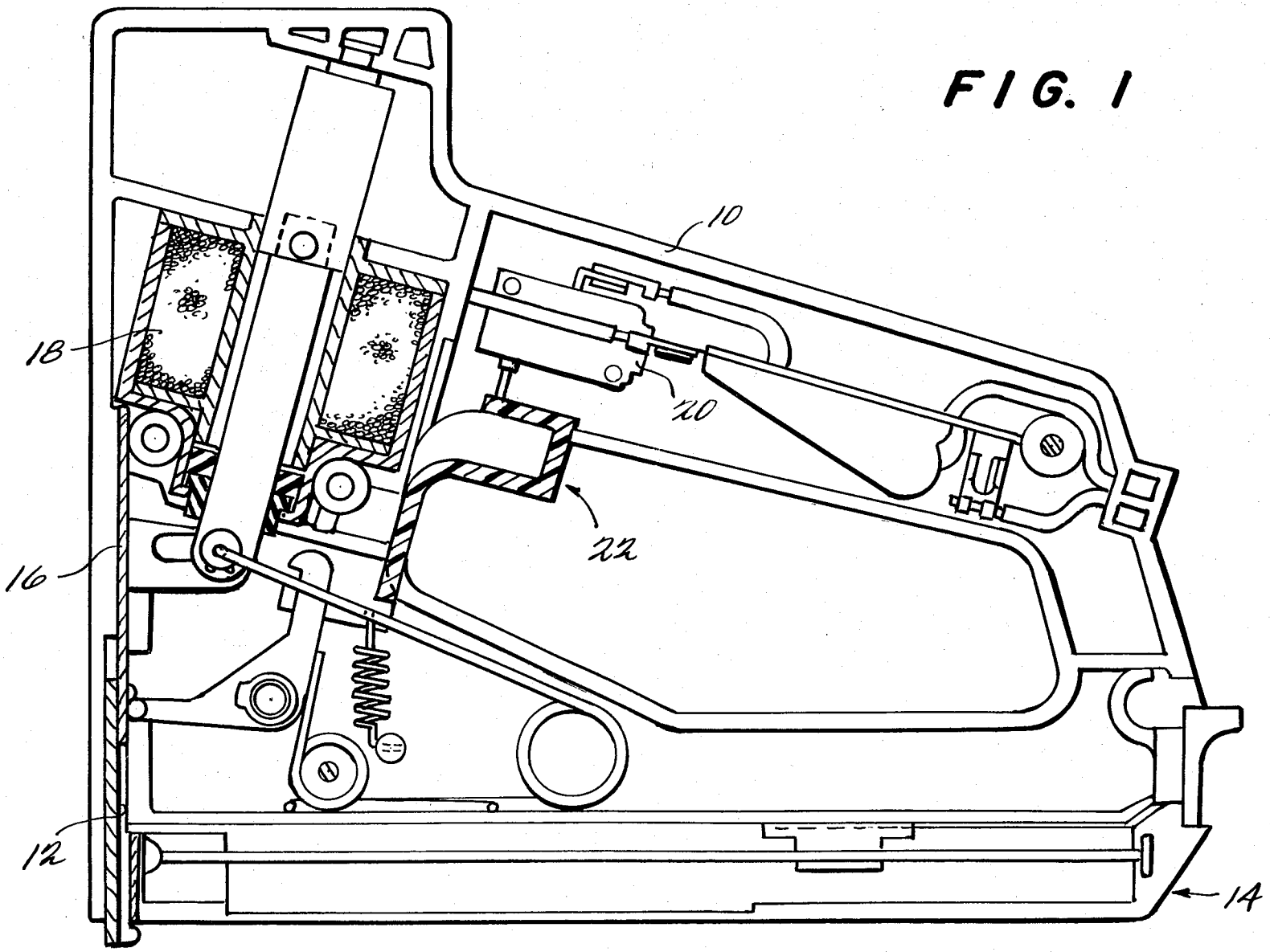
FIG. 1 is a vertical sectional view of a fastener driving device shown as an example of a device to which the present invention applies.

Referring now to FIG. 1 there is shown a vertical sectional view of an exemplary embodiment of a fastener driving device to which the present invention applies. The fastener driving device includes a housing 10 defining a drive track 12. A magazine 14 is provided for feeding fasteners to drive track 12 so that they can be driven one at a time by driver 16. Driver 16 is powered through a drive stroke in drive track 12 by power derived from a solenoid 18. To initiate a fastening operation, a user pulls on a trigger 22 which actuates an electrical contact switch 20. Switch 20 forms a part of an actuating circuit embodying the principles of the present invention since the invention is particularly concerned with the circuit and its function in connection with the basic components of the fastener driving device thus far described, the detailed construction of the basic components will not be described, it being understood that reference may be made to the aforesaid Bernecki et al application for any detailed understanding required.

Figure 2:
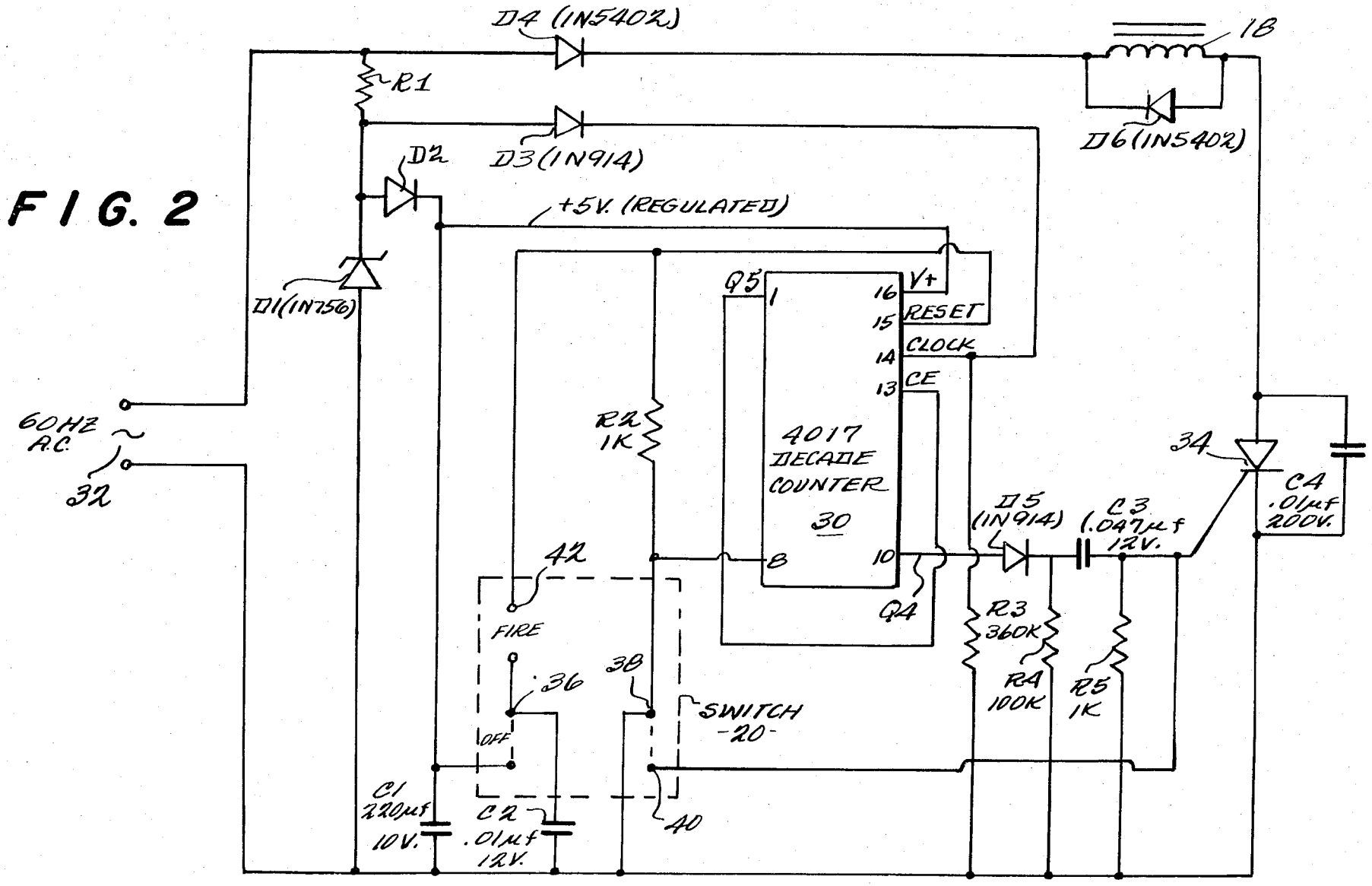
FIG. 2 is a schematic diagram of the actuating circuit according to the present invention.

Referring now to FIG. 2, there is shown a detailed schematic diagram of the actuating circuit according to the invention. As previously stated, the circuit is intended to provide a firing signal to energize solenoid 18 over a single AC half wave for each actuation of a switch 20. The heart of the actuating circuit is a decade counter 30, preferably a 4017 integrated circuit decade counter. The pin numbers in FIG. 2 refer to a 4017 integrated circuit for reference purposes. Of course, other digital counters could be employed with appropriate pin number changes, etc.

Decade counter 30 is clocked at its pin 14 by a signal derived from the power line voltage used to actuate solenoid 18. The clock signal is developed by diode D3, and resistors R1 and R3 providing a positive 5 V pulse for each positive half cycle of AC power line voltage. The counter advances its output on the positive going edge of each clock pulse. It includes a clock enable pin (CE) input at its pin 13 for disabling the clock when a logic level "1" signal is applied thereto.

Power input to the actuating circuit is provided by terminals 32 intended for coupling to a commercial 60 Hz AC power source. Resistor R1, Zener diode D1, diode D2 and capacitor C1, together form a regulated five volt power supply for supply V+ power to pin 16 of decade counter 30. Decade counter 30 supplies a Q 4 output at its pin 10 to drive the gate of a silicon controlled rectifier (SCR) 34, preferably a 52008 LS2, through a diode D5 and a capacitor C3, capacitor C3 in circuit with resistors R4 and R5 create a short duration pulse from the approximately 16 msec. logic level high signal appearing at pin 10 of decade counter 30. Resistor R5 also functions as a $R_{GK}$ to SCR 34.

Decade counter 30 provides a Q5 output at its pin 1 which is coupled to its pin 13 to provide a clock enable signal for the counter. Reset signals are provided to decade counter 30 at its pin 15. A reset signal applied to pin 15 in the form of a positive pulse resets the counter to output Q0. A resistor R2 coupling reset pin 15 to V- pin 8 pulls the reset pin low.

Capacitor C2 coupled between a terminal 38 of switch 20 and one side of the AC power supply which is normally connected through switch 20 via its terminal 36 to the five volt regulated power supply when switch 20 is "off". When switch 20 is moved to its normally open position, as illustrated in FIG. 2, one end of capacitor C2 is connected to reset pin 15 via resistor R2 and a switch terminal 38. This causes C2 to quickly discharge through resistor R2.

Also provided in the circuit is a diode D4 for protecting decade counter 30 from any back EMF developed by solenoid 18. Diode D6 is provided across solenoid 18 to effectively short the back EMF of the solenoid to create a dynamic breaking effect on the solenoid piston.

A capacitor C4 is provided across SCR 34 to suppress the change of voltage with respect to time for the power SCR. The actuating circuit functions as follows:

When AC line voltage is first applied to terminal 32 a clock pulse becomes immediately present at clock pin 14 of decade counter 30. As the power supply charges up to five volts, it is possible that counter 30 will begin to count from an output which precedes the Q4 output, which drives the gate of SCR 34. If that were to happen, a full power solenoid activation would occur when power was initially applied. In a practical embodiment, if the circuit were used in an electric stapling machine, a full power solenoid activation might occur when the stapler was initially plugged into the commercial power. This undesirable effect is prevented by grounding the gate of SCR 34 through a terminal 40 of switch 20 when the switch is in its "OFF" position.

Once counter 30 has advanced past the Q4 output and its Q5 output at pin 1 becomes high, the Q5 serves as a clock enable by its connection to clock enable pin 13. This causes counter 30 to latch itself in the Q5 state. Counter 30 holds itself at the Q5 state until a positive pulse is applied to reset pin 15 of the counter.

When counter 30 is reset, its Q0 output (not shown) goes high and the counter advances outputs on the rising edges of the clock signal applied to pin 14. In this case, the clock signal is provided by the 60 Hz power line frequency. Thus, it is clocked at the rate of 60 pulses each second. As the Q4 (pin 10) output of decade counter 30 goes high, capacitor C3 in circuit with resistors R4 and R5 allow a single short duration pulse to reach the gate of SCR 34. Counter 30 advances at a point in time when the AC wave from which the clock pulses derive reaches about 3–5 volts and is rising. As such, SCR 34 is triggered "on" for essentially all of the AC half cycle following a Q5 output of the counter. This will occur five cycles of AC after actuation of switch 20 to its fire position wherein terminal 36 becomes electrically coupled to a terminal 42.

When switch 20 is thrown to its "fire" position such that terminal 36 becomes coupled to terminal 42, the reset pulse is supplied by capacitor C2 which is charged by the power supply through switch 20 when it is in the normally closed position. When switch 20 is moved to the "fire" position, capacitor C2 causes the reset pin 15 to become high for a brief instant as the capacitor discharges through resistor R2. The time constant of R2 C2 is selected to be about 10 microseconds thereby eliminating the possibility of resetting counter 30 a second time without fully charging capacitor C2 by returning switch 20 to its normal closed position. After SCR 34 fires, counter 30 latches itself at Q5 awaiting another reset pulse before the entire sequence can be repeated if desired. When SCR 34 fires, a complete circuit is formed including solenoid 18 thereby causing a power actuation of the circuit.

Figure 3:
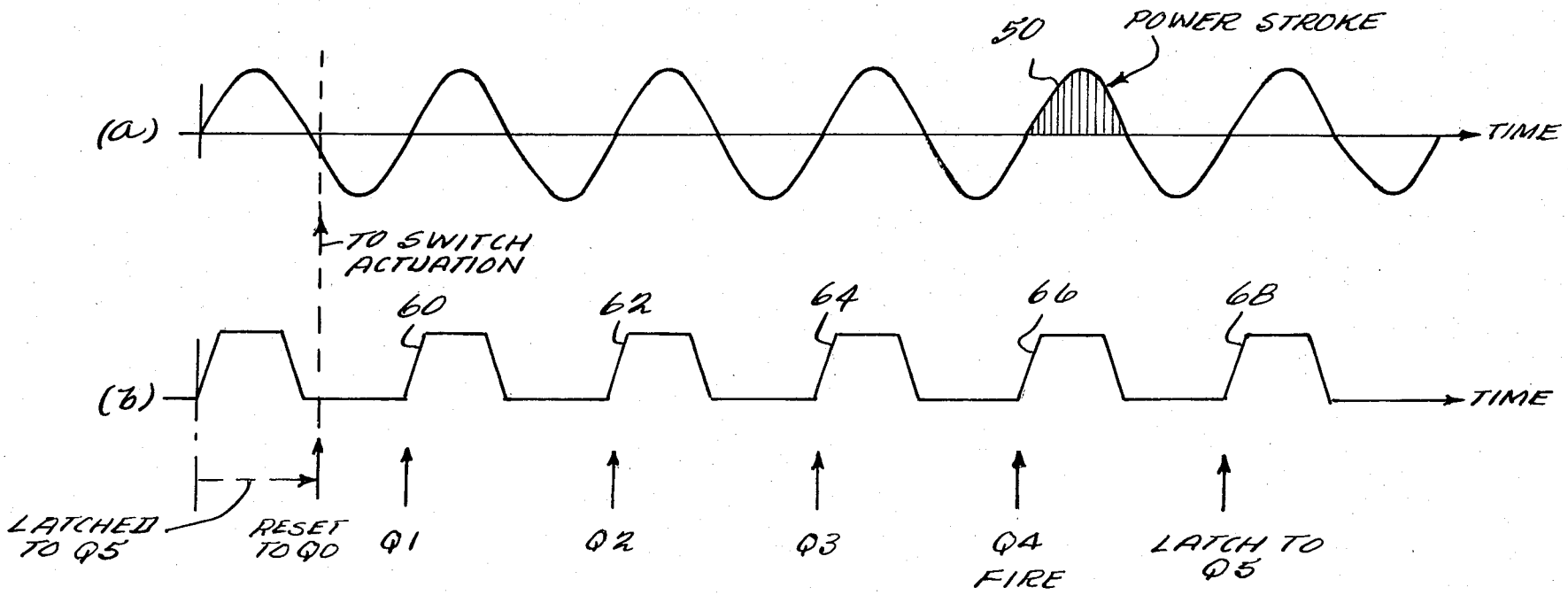
FIG. 3 is a graphical diagram explaining the operation of the actuating circuit according to the present invention.

Referring now to FIG. 3, there is shown a graphical diagram explaining the normal operation of the actuating circuit. FIG. 3(*a*) represents the power line voltage input to terminals 32 and FIG. 3(*b*) represents the 5 V pulses provided at clock pin 14 by diode D3 and resistors R1 and R3. It is assumed that power has been applied to terminals 32 for some time and that switch 20 is in its "off" or un-actuated position. Also some time has lapsed since the last actuation of switch 20.

Counter 30 is latched in its Q5 state. This is because the counter's Q5 output is coupled directly to the clock enable (CE) input of the counter at pin 13. For a 4017 counter, a "1" ("high") on the CE disables the clocking of the counter.

The actuation of switch 20 with respect to the cycles of AC power is random. We assume here that switch actuation occurs at time $t_0$. Upon actuation of switch 20 by the user, capacitor C2 becomes connect in circuit so as to discharge through resistor R2. This discharge creates a voltage pulse at the function of capacitor C2 and resistor R2. This function is coupled to RESET pin 15 of decade counter 30, thereby causing the counter to be reset to its Q0 output.

Once reset, counter 30 begins to count up, i.e. Q0, Q1, . . . on the leading edges of the input coupled to its clock pin 14, represented by the pulses shown in FIG. 3(*b*). On leading edge 60, counter 30 switches (counts) to its Q1 output. Similarly, on leading edges 62, 64 and 66 it counts to is Q2, Q3 and Q4 outputs, respectively. Since the output of counter 30 is taken on pin 10, corresponding to its Q4 output, a firing signal is developed by diode D5, capacitor C3 and resistors R4 and R5. This firing signal is coupled to the gate of SCR 34 to fire it, thereby energizing solenoid to a power stroke represented by reference numeral 50 in FIG. 3(*a*).

After power stroke 50, the next leading edge 68 of the clock pulses causes counter 30 to count to its Q5 output. Since the Q5 output is wired directly to the CE input at pin 13, the Q5 output disables the counting of clock pulses and the counter latches at Q5 to await the next actuation of switch 20. Thus, the tool will be fired for substantially a full positive half cycle of AC power that occurs four (4) cycles after actuation of switch 20.

There is a possibility that when power is first applied to terminals 32, such as for example when the tool is plugged into a commercial power outlet, counter 30 will assume a state of Q0 . . . Q4 i.e. below Q5. Normally counter 30 would immediately begin counting clock pulses up to Q5 and then fire without switch 20 ever being actuated. To prevent this, the gate of SCR 34 is "grounded" through terminals 38 and 40 of switch 20 until the switch is actuated. Thus, no matter what state counter 30 assumes when power is first applied, it will simply count until it latches itself at Q5 whereupon it stops counting.

Of course, the output of counter 30 could be taken as some output other than Q4, such as for example Q5, Q6 . . . Q8. In such cases, firing would occur 5, 6 . . . 8 cycles after actuation of switch 12.

While the invention has been described in connection with what is presently considered to be the most practical and preferred embodiments, it is to be understood that the invention is not to be limited to the disclosed embodiments but on the contrary, is intended to cover various modifications and equivalent arrangements included within the spirit and scope of the appended claims which scope is to be accorded the broadest interpretation so as to encompass all such modifications and equivalent structures.

I claim:

1. An electrically operated fastener driving device comprising:
   - a housing assembly defining a drive track;
   - a driver movably engaged within said drive track;
   - a magazine for feeding fasteners to said drive track for being driven by said driver;
   - a solenoid energizable to move said driver through a drive stroke in said drive track;
   - circuit means, including a controlled conduction device having a control electrode, for conducting power from an AC potential source to said solenoid to energize it whenever a firing signal is applied to said control electrode;
   - switch means having a normally "off" position and operable in response to an actuation to move into a "fire" position at a random time relative to the cycles of the AC potential; and
   - counter means for (a) counting the cycles of AC potential occurring after an actuation of said switch means from its normally "off" position to its "fire" position and (b) applying a firing signal to said control electrode to place said controlled conduction means in a conductive state during a properly poled half cycle of said AC potential occurring a predetermined number of cycles greater than one (1) after the actuation of said switch means, the conductive state of said controlled conductive device causing said solenoid to be energized, and (c) preventing the application of a further signal to said control electrode after the application of said firing signal until said switch means is returned to its "off" position and reactuated to its "fire" position.

2. A fastener driving device according to claim 1 wherein said counter means comprises a decade counter.

3. A fastener driving device according to claim 2 wherein said decade counter is an MC14017 integrated circuit.

4. A fastener driving device according to claim 2 wherein said counter means comprises (a) means operative when said switch means is in its "off" position for latching said counter means at a first predetermined count by disabling the counting of AC potential cycles (b) means, responsive to actuation of said switch means, for resetting said counter and control circuit means to count up from zero, and (c) means for providing said firing signal when said counter counts to a second predetermined count less than first predetermined count to which said counter means has been latched.

5. A fastener driving device according to claim 4 wherein said resetting means comprises a capacitor in circuit arranged so as to charged when said switch means is in its "off" position and to discharge when said switch means is actuated to its "fire" position so as to supply a signal for resetting said counter means.

6. A fastener driving device according to claim 4 wherein said counter means comprises a clock input for receiving signals to be counted and wherein said means for counting comprises circuit means for generating, in response to the AC potential, a pulse train including one pulse for each cycle of AC potential and means for coupling said pulse train to said clock input.

7. A fastener driving device according to claim 4 wherein said counter means comprises a clock enable (CE) input and wherein said latch means comprises a circuit connection from a counter output corresponding to said first predetermined count to said CE input.

8. A fastener driving device according to claim 4 wherein said firing signal providing means comprises a pulse forming circuit coupling an output of said counter corresponding to said second predetermined count to said control electrode.

9. A fastener driving device according to claim 1 wherein said controlled conduction device is a silicon controlled rectifier (SCR).

10. A fastener driving device according to claim 1 wherein said counter means comprises means for applying said firing signal during the second properly poled half cycle of AC potential following a switch actuation.

11. A fastener driving device according to claim 1 wherein said counter means comprises means for applying said firing signal during the third properly poled half cycle of AC potential following a switch actuation.

12. A fastener driving device according to claim 1 wherein said counter means comprises means for applying said firing signal during the fourth properly poled half cycle of AC potential following a switch actuation.

13. A fastener driving device according to claim 1 wherein said counter means comprises means for applying said firing signal during the fifth properly poled half cycle of AC potential following a switch actuation.

14. A fastener driving device according to claim 1 wherein said counter means comprises means for connecting said control electrode to a circuit ground when said switch means is in its "off" position.

15. An electrically operated fastener driving device comprising:

a housing assembly defining a drive track;

a driver movably engaged within said drive track;

a magazine for feeding fasteners to said drive track for being driven by said driver;

a solenoid for moving said driver through a drive stroke in said drive track;

circuit means, including a controlled conduction device having a control electrode, for conducting power from an AC potential source to said solenoid to energize it whenever a firing signal is applied to said control electrode;

a switch, having a normally "off" position and a "fire" position, operable at a random time relative to the cycles of the AC potential source;

counter means, coupled to said circuit means for counting a predetermined number of cycles of AC potential occurring after an actuation of said switch to said "fire" position and providing a counter signal indicative thereof;

firing circuit means, coupled to said counter means, for (a) providing a firing signal, responsive to said counter signal, to said control electrode for causing said controlled conduction device to conduct during the first properly poled half cycle of AC potential occurring after said counter signal thereby energizing said solenoid and (b) preventing the application of a further signal to said control electrode after the application of said firing signal until said switch is returned to its "off" position and reactuated to its "fire" position.

16. A fastener driving device according to claim 15 wherein said counter means provides said counter signal during the second cycle of said AC potential following a switch actuation to its "fire" position.

17. A fastener driving device according to claim 15 wherein said counter means provides said counter signal during the third cycle of said AC potential following a switch actuation to its "fire" position.

18. A fastener driving device according to claim 15 wherein said counter means provides said counter signal during the fourth cycle of said AC potential following a switch actuation to its "fire" position.

19. A fastener driving device according to claim 15 wherein said counter means provides said counter signal during the fifth cycle of said AC potential following a switch actuation to its "fire" position.

20. A fastener driving device according to claim 15 further including means for latching said counter means at a first predetermined count higher than said predetermined number of cycles of AC potential by disabling the counting of AC cycles; and means responsive to the actuation of said switch to its "fire" position for resetting said counter to count up from zero toward said predetermined number of cycles of AC potential.

21. A fastener driving device according to claim 20 wherein said counter means comprises a decade counter having a clock input, for receiving signals to be counted, a clock enable input for controlling whether signals coupled to said clock input are counted and Q0 . . . Q9 outputs for providing output signals indicative of the count of said decade counter.

22. A fastener driving device according to claim 21 wherein said latching means comprises a circuit connection from a Q output corresponding to said first predetermined count to said clock enable input.

23. A fastener driving device according to claim 22 wherein said counter signal is provided by one of the Q outputs of said counter.

24. A fastener driving device according to claim 21 wherein said means for resetting comprises a capacitor in circuit so as to be charged when said switch is in said "off" position;

circuit means for discharging said capacitor responsive to an actuation of said switch to its "fire" position, so as to generate a reset pulse; and circuit means for coupling said reset pulse to a reset input of said counter.

25. A fastener driving device according to claim 21 wherein said counter comprises an MC14017 integrated circuit.

26. An actuating circuit for a tool comprising:

winding means for operating said tool;

circuit means, including a controlled conduction device having a control electrode for conducting power from an AC potential source to said winding means whenever a firing signal is applied to said control electrode;

switch means having a normally "off" position and a "fire" position operable at a random time relative to the cycles of the AC potential; and counter means for (a) counting the cycles of AC potential occurring after an actuation of said switch means from its normally "off" position to its "fire" position and (b) applying a firing signal to said control electrode to place said controlled conduction device in a conductive state during a properly poled half cycle of said AC potential occurring a predetermined number of cycles greater than 1 after the actuation of said switch means thereby energizing said winding means, and (c) preventing the application of a further signal to said control electrode after the application of said firing signal until said switch means is returned to its "off" position and reactuated to its "fire" position.

27. An actuating circuit according to claim 26 wherein said counter means comprises a decade counter.

28. An actuating circuit according to claim 26 wherein said controlled conduction device is a silicon controlled rectifier (SCR).

29. An actuating circuit according to claim 26 wherein said counter means comprises means for connecting said control electrode to a circuit ground when said switch means is in its "off" position

30. An actuating circuit for a tool comprising:

winding means for operating said tool;

circuit means, including a controlled conduction device having a control electrode, for conducting power from an AC potential source to said winding means to energize it whenever a firing signal is applied to said control electrode;

a switch, having a normally "off" position and a "fire" position, operable at a random time relative to the cycles of said AC potential source;

counter means, coupled to said circuit means for counting a predetermined number of cycles of AC potential occurring after an actuation of said switch to said "fire" position and providing a counter signal indicative thereof;

firing circuit means, coupling said counter means to said control electrode, for (a) providing a firing signal responsive to said counter signal to said control electrode for causing said controlled conduction device to conduct during the first properly poled half cycle of said AC potential occurring after said counter signal thereby energizing said winding and (b) preventing the application of a further firing signal to said control electrode after the application of said firing signal until said switch is returned to its "off" position and reactuated to its "fire" position.

31. An actuating circuit according to claim 30 further including means for latching said counter means at a first predetermined count higher than said predetermined number of cycles of AC potential by disabling the counting of AC cycles; and means responsive to the actuation of said switch to its "fire" position for resetting said counter means to count up from zero toward said predetermined number of cycles of AC potential.

32. An actuating circuit according to claim 31 wherein said counter means comprises a decade counter having a clock input, for receiving signals to be counted, a clock enable input for controlling whether signals coupled to said clock input are counted and Q0 . . . Q9 outputs for providing output signals indicative of the count of said decade counter.

* * * * *